US005112035A

United States Patent [19]

Yamamoto et al.

[11] Patent Number: 5,112,035

[45] Date of Patent: May 12, 1992

[54] SORTER

[75] Inventors: Hiroshi Yamamoto, Ibaraki; Hiroshi Tobita, Omiya, both of Japan

[73] Assignee: Ikegami Tsushinki Co., Ltd., Tokyo, Japan

[21] Appl. No.: 639,200

[22] Filed: Jan. 9, 1991

[30] Foreign Application Priority Data

Jan. 16, 1990 [JP] Japan ..... 2-6561

[51] Int. Cl.[5] ..... B65H 39/11

[52] U.S. Cl. ..... 270/53; 270/58; 271/293

[58] Field of Search ..... 270/37, 52, 53, 58; 271/287, 292, 293, 294

[56] References Cited

U.S. PATENT DOCUMENTS

| | | | |
|---|---|---|---|
| 4,376,529 | 3/1983 | George | 270/53 |
| 4,433,837 | 2/1984 | Romanowski . | |
| 4,605,211 | 8/1986 | Sonobe | 270/53 |
| 4,925,171 | 5/1990 | Kramer | 270/53 |

FOREIGN PATENT DOCUMENTS

| | | | |
|---|---|---|---|
| 0301538 | 2/1989 | European Pat. Off. . | |
| 301595 | 2/1989 | European Pat. Off. | 270/53 |
| 0301596 | 2/1989 | European Pat. Off. . | |
| 0425988A2 | 5/1991 | European Pat. Off. . | |
| 2363558 | 7/1974 | Fed. Rep. of Germany . | |
| 61-287663 | 12/1986 | Japan . | |
| 48779 | 2/1989 | Japan | 270/52 |
| 75362 | 3/1989 | Japan | 270/58 |

*Primary Examiner*—Edward K. Look
*Assistant Examiner*—Therese M. Newholm
*Attorney, Agent, or Firm*—Oliff & Berridge

[57] ABSTRACT

A sorter includes a plurality of vertically movable trays which are each formed with a cut-out in one corner. The trays are supported so that the corners in which the cut-outs are formed are lower than the other corners of the tray. Rear and side walls flank the cut-outs. Due to the skewed angle of the trays sheets which are ejected thereonto slide under their own weight to the corners in which the cut-outs are formed. A tray shift mechanism includes groups of two Geneva wheels each formed with one or more recesses which can pick-up tray pins and guide the same along guide slots. The guide slots are formed with shaped portions which induces one tray at a time to be moved laterally to a position wherein sheet collection or stapling can be carried out. A spring loaded stopper cooperates with each set of two Geneva wheels and holds the pins which have been carried to a laterally displaced position by one wheel, against the periphery of the wheels ready for pick up by the other wheel.

14 Claims, 9 Drawing Sheets

SORTER

BACKGROUND OF THE INVENTION

1. Field of the Invention

The present invention relates generally to a sorting device for use with copy and printing machines and more specifically to such a sorter which includes a novel collection tray and stapler arrangement.

2. Description of the Prior Art

Sorters which include staplers are required to firstly sort and accumulate sheets of printed matter in carefully aligned stacks before fastening the same at a predetermined location such as the upper left hand corner.

Various arrangements have been proposed to accomplish the above mentioned alignment and fastening. Arrangements for aligning the sheets prior the stapling operation have included trays which are provided with slots and shafts which extend up through the slots and which be moved along the slots so that they engage the edge of the sheets and push the same across the tray into engagement with stoppers provided along one side thereof.

In connection with the stapling devices used in such arrangements, Japanese Patent Application Laying-Open No. 61-287663 discloses a proposal wherein the trays above and below the one on which the sheets to be fastened are accumulated, are arranged at relatively large spacings with respect to the intermediate one so that a stapler can be moved into a suitable operating position with respect to the accumulated stack of sheets.

However, with the above types of alignment arrangements, drawbacks are encountered in that actuators and associated mechanisms are required to move the shafts back and forth along the slots. These devices of course consume relatively large amounts of space and thus tend to undesirably increase the size, complexity and attendant cost of the sorter.

Further, the above mentioned types of stapling arrangements are such as to require mechanisms which can locate the stapler at the desired position and subsequently actuate the same. In addition to this, relatively large spaces must be provided between adjacent trays so as to facilitate the positioning of the stapler which induces the problem that the overall height of the sorter is increased and cannot be readily reduced.

SUMMARY OF THE INVENTION

It is an object of the present invention to overcome the above mentioned prior art drawback and provide a sorter which exhibits a high processibility of sheets, which is both compact and relatively inexpensive.

Another object of the present invention is to provide a stapler equipped sorter wherein trays can be arranged at small intervals and in a manner which enables the overall height of the sorter to be reduced.

In order to achieve the above object, a first aspect of the present invention provides a sorter which features: a plurality of vertically movable trays; means for vertically shifting the plurality of trays and for maintaining a selected tray in a predetermined position in which sheets can be received thereon, the shifting and maintaining means including at least one set of vertically arranged Geneva wheels which are rotatably supported in a predetermined relationship with one another and which are arranged to cooperate with one another in a predetermined manner, each of the Geneva wheels having at least one recess formed therein; means for ejecting a sheet onto the a tray which is maintained in the predetermined position; fastening means for fastening a stack of sheets together; and means associated with the plurality of Geneva wheels for inducing a tray to undergo lateral displacement in the direction of the fastening means.

In accordance with the present invention the fastening means can be a stapler or alternatively, a book binding device which applies an adhesive or the like along a selected edge of the collected sheets.

In the above type of sorter, the plurality of trays is formed with: a cut-out formed in one corner; an upwardly extending rear wall which extends toward the cut-out; and a first side wall which extends toward the cut-out.

In accordance with the invention the sorter further includes means for orienting each of the trays so that the corner in which the cut-out is formed is maintained at a level which is lower than the other corners. Due to this skewed angle, the sheets which are ejected thereonto slide under their own weight to the corners in which the cut-outs are formed.

A further feature of the invention is that each of the trays may further comprise a second side wall which extends downwardly from a second side edge thereof, the second side wall having a height which is greater than that of the first side wall. The first and second side walls have leading and trailing ends respectively, while the second side walls has horizontally extending tray pins located proximate the leading and trailing ends respectively, and the first side wall has a tray pin located proximate its trailing end.

The above mentioned shifting and maintaining means may comprise: a frame in which first and second guide slots are formed, the first and second guide slots slidably receiving the tray pins which extend from the locations proximate the trailing edges of the first and second walls, respectively; first and second sets of Geneva wheels associated with each of the first and second guide slots, respectively, each of the first and second Geneva wheel sets comprising two Geneva wheels, each of the first and second sets of Geneva wheels being arranged to operatively engage tray pins which are slidably received in the first and second guide slots and move the tray pins along the first and second guide slots respectively; and drive means for selectively driving the first and second sets of Geneva wheels in the same rotational direction.

It is within the scope of the present invention that the Geneva wheels which are associated with each of the guide slots are arranged at the same height.

It is further within the scope of the present invention that the above mentioned sheet ejecting means comprises a transfer roller and a pinch roller, the transfer roller and pinch roller being rotatably supported on a transfer roller shaft and a pinch roller shaft respectively, the transfer roller shaft and the pinch roller shaft being arranged to extend at a given angle across the frame.

In accordance with the present invention the above mentioned first and second guide slots may extend vertically and may have central portions, each of the central portions having mirror image first and second curved portions which each respectively corresponds to about ¼ of the locus of the recess formed in a Geneva wheel, and mirror image tangential extrapolations which merge together at an intersection portion.

In accordance with the present invention the sorter may further comprise biasing means for urging a tray pin which is located an intersection portion against the periphery of a Geneva wheel.

A further feature of the present invention is that each set of Geneva wheels comprises two Geneva wheels, each Geneva wheel comprising two recesses which are formed at essentially diametrically opposite locations.

In accordance with a second aspect of the present invention, a sorter features: a plurality of vertically movable trays which have tray pins slidably received in guide slot means; shifting means for vertically displacing the plurality of trays and for maintaining a tray in a predetermined position in which sheets can be received thereon, the shifting means including: (a) at least one set of vertically arranged Geneva wheels which are rotatably supported in a predetermined relationship with one another and which are arranged to cooperate with one another in a predetermined manner, each of the Geneva wheels having at least one recess formed therein, and (b) biasing means for biasing a tray pin which is located at a predetermined portion of the guide slot means against the periphery of at least one of the Geneva wheels; means for ejecting a sheet onto the a tray which is maintained in the predetermined position; fastening means for fastening a stack of sheets together; and means associated with the plurality of Geneva wheels for inducing a tray to undergo lateral displacement in the direction of the fastening means.

In accordance with a further aspect of the present invention, a sorter features: a frame; a guide slot formed in the frame, the guide slot having a shaped central portion comprising mirror image curved portions and mirror image extrapolations which merge at an intersection portion; a plurality of vertically movable trays, each of the trays having a tray pin slidably received in the guide slot; first and second Geneva wheels, the Geneva wheels being mounted so that the peripheral edges thereof are located in close proximity to one another and operatively connected with selectively energizable drive means in a manner to be driven in the same rotational direction; means defining first and second recesses in a peripheral edge the first and second Geneva wheels respectively, the first and second Geneva wheels being located so that portions of the loci of the first and second recess have a predetermined overlapping relationship with the mirror image curved selectively energizable drive means in a manner to be driven in the same rotational direction; means defining first and second recesses in a peripheral edge the first and second Geneva wheels respectively, the first and second Geneva wheels being located so that portions of the loci of the first and second recess have a predetermined overlapping relationship with the mirror image curved portions of the first guide slot; and a resilient stopper which is disposed at the intersection portion of the guide slot and arranged to bias a tray pin which is moved along the guide slot to the intersection portion, against the peripheral edges of the first and second Geneva wheels.

In summary, as the ejected sheets move under the influence of their own weight to the corners of the trays in which the cut-outs are formed it is not necessary to provide a mechanism for arranging the sheets into neat stacks prior stapling, and hence the sorter is simplified the sorting process rendered quicker and the overall size of the sorter reduced.

Additionally as the sheets move and stack on one corner of the tray irrespective of the sheet size, sheets of mixed sizes can be formed into a stack as readily as if the sheets were all the same.

Further, as the stapler is disposed in a relatively low position in the sorter, and the trays are moved downwardly theretoward, the overall height of the sorter can be notably reduced.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

Figure 1:
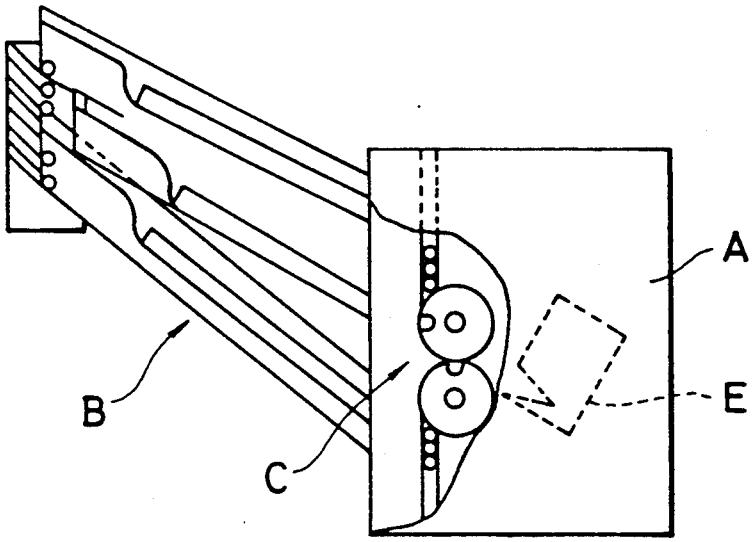
FIG. 1 is a partially cut-away side elevational view showing a stapler equipped sorter according to a first embodiment of the present invention.
Figure 2:
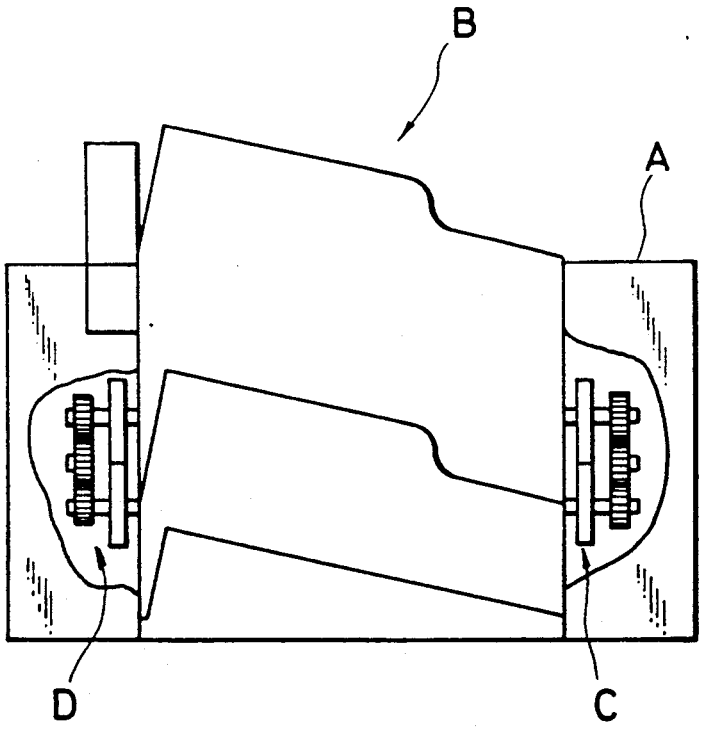
FIG. 2 is a partially cut-away front elevation view of the sorter shown in FIG. 1.
Figure 3:
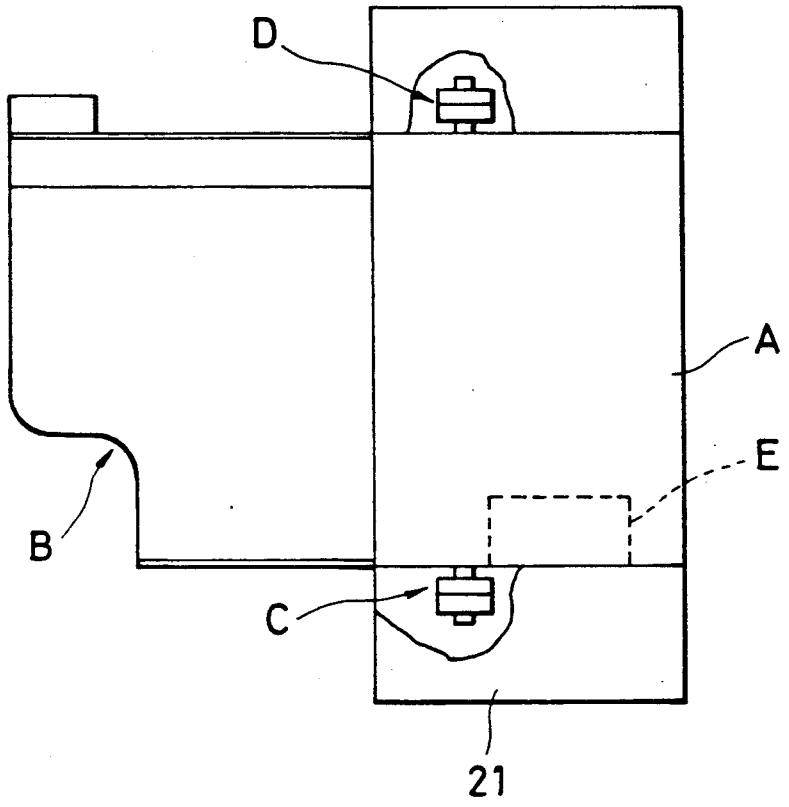
FIG. 3 is a partially cut-away plan view of the first embodiment of the present invention.

FIGS. 1 to 6 show a first embodiment of the present invention. Among these drawings FIGS. 1 to 3 show the general outline and arrangement of the stapler equipped sorter according to the present invention. In these figures, A denotes the main casing; B denotes the trays onto which sheets of printed matter and the like are collected; C and D denote the mechanisms which are used to shift the trays and maintain the same on which sheets can be ejected during the operation of the sorter and which are characterized by the use of 2 sets of Geneva wheels; and E denotes a stapler mounted within the main casing A.

Figure 4:
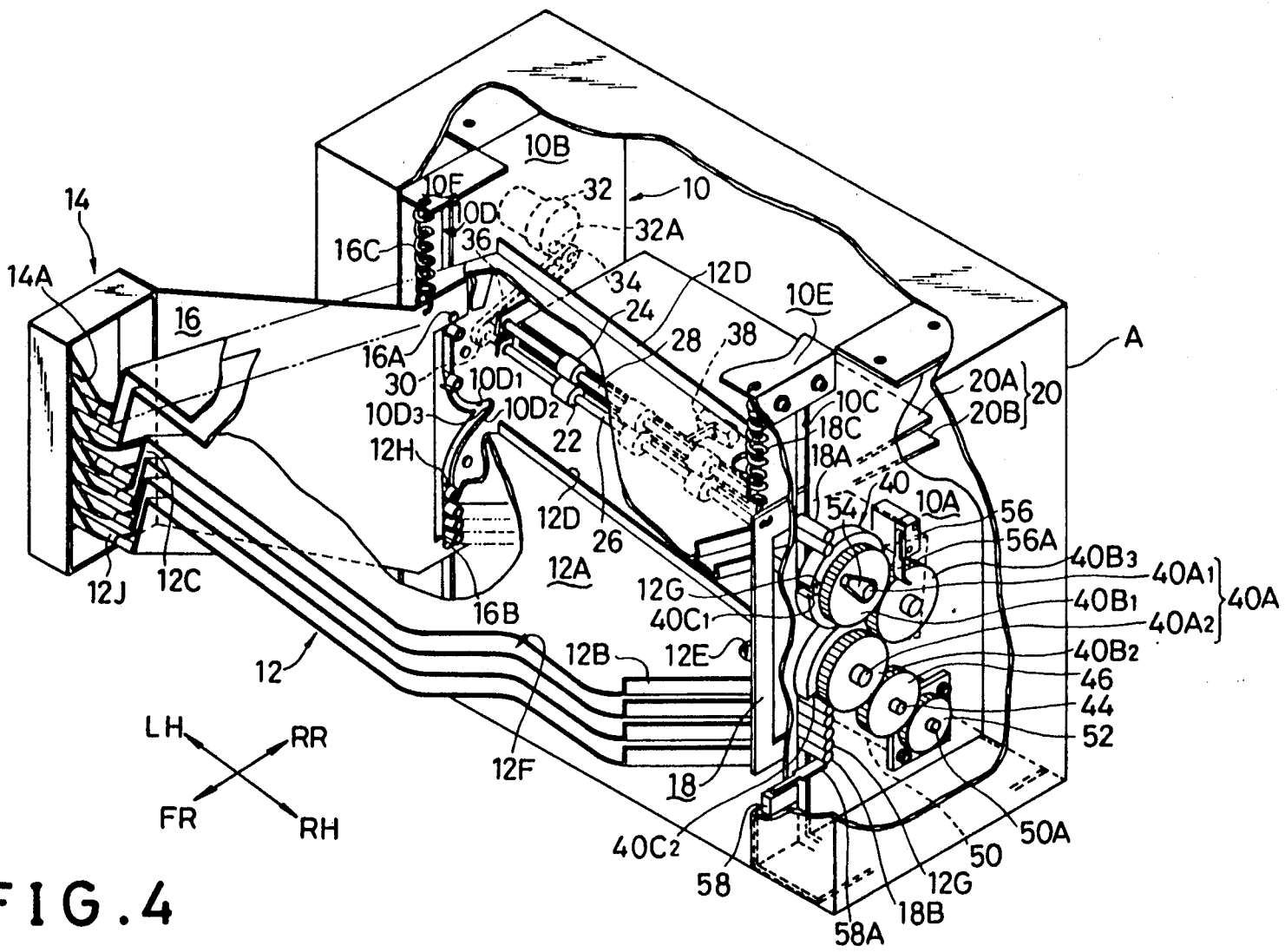
FIG. 4 is a partially cut-away perspective view showing details of the trays and associated tray shift mechanisms according to the first embodiment of the invention.

FIG. 4 shows in perspective view, details of a first embodiment of the present invention. In this view the arrows FR, RR, RH and LH respectively denote the front, rear, right and left side of the sorter.

The main casing A includes a main frame 10 which comprises a right hand side frame 10A and a left side frame 10B. The side frames 10A, 10B are formed with essentially vertically extending guide slots 10C and 10D, respectively. The mid-portions of these guide slots are formed with curved non-linear portions $10C_1$, $10C_2$ and $10D_1$, $10D_2$. As shown, these portions have a curvature selected in accordance with radius of Geneva wheels which will be discussed in more detail later (see FIG. 4 wherein guide slot 10D is clearly visible).

In this figure the numeral 12 is used to denote the trays B. A plurality of trays $12_1$-$12n$ are arranged in vertical movable array. Each of the trays are constructed in a manner to have a lower wall or base 12A, and integral vertically extending walls 12B, 12C and 12D. The walls 12B and 12D project up normally from the right and rear edges of the lower wall 12A while the side wall 12C projects vertically downwardly from the left edge of 12A. The side wall 12C has a greater vertical dimension than the side walls 12B.

As the trays 12 are formed with the side walls 12B and 12C, they exhibit an increased structural rigidity which allows for the thickness of the same to be reduced.

The right rear corner of each tray is formed with a cut-out 12E which permits the stapler to be placed an operative position with respect to the sheets which are accumulated thereon.

The front right corner of each of the trays is formed with a cut-out 12F which facilitates manual removal of the sheets.

The side walls 12B and 12C are formed with horizontal tray pins 12G and 12H which are slidably received in the previously mentioned guide slots 10D and 10C.

A horizontally extending guide pin 12J is formed the forward lower corner of each of the side walls 12C. These pins 12J are arranged to be received in a front guide member 14.

In this embodiment the front guide member 14 is formed with a plurality of guide grooves 14A ($14A_1$-$14An$) corresponding in number to the n number of trays 12.

Tray pins $12H_1$-$12Hn$ which are provided on the left hand side of the trays 12 are accommodated in the guide slot 10C between guide pins 16A and 16B which are formed on a vertically movable left carrier side plate 16. The front guide member is fixedly connected to a forward end of the left carrier side plate 16 so as to be vertically movable therewith.

On the other hand, a vertically movable right carrier side plate 18 is disposed on the right side of the device and provided with guide pins 18A and 18B. The guide pins 18A and 18B are received in the guide slot guide slot 10D at locations above and below the tray pins 12G ($12G_1$-$12Gn$).

The carrier side plates 16, 18 are each resiliently connected to the side frames 10A, 10B by way of hanger brackets 10F, 10E and tension springs 16C and 18C.

SHEET TRANSFER MECHANISM

The sheet transfer mechanism utilized in this embodiment comprises laterally extending guide plates 20A and 20B which are fixedly connected with the main frame 10, and arranged one above the other at a predetermined spacing in a manner to define an incoming sheet transfer guide 20. This transfer guide 20 has an inlet which is positioned in a manner to receive sheets from a non-illustrated copy or printing machine, and an outlet adjacent which a transfer roller 22 and a corresponding pinch roller 24 are disposed. The transfer roller 22 and the pinch roller 24 are rotatably supported on the right side frame 10A and the left side frame 10B, by way of shafts 26 and 28, respectively. The shafts 26, 28 are arranged at a predetermined inclination with respect to the horizontal. The trays 12 are also arranged at an angle and thus enables the overall height of the main casing to be reduced. The transfer roller shaft 26 has a pulley 30 fixedly connected thereto. A motor 32 which is mounted on the left side frame 10B, has an output shaft 32A on which a pulley 34 is mounted. A drive belt 36 establishes a drive connection between the pulleys 30, 34.

A sheet sensor 38 is mounted on the lower side of the guide plate 20B. This sensor 38 includes a detection lever 38A which is arranged to project into the transfer guide 20.

TRAY SHIFT AND MAINTAIN MECHANISM

Two Geneva wheel arrangements generally denoted by the numerals 40, 42 are rotatably mounted on the side frames 10A and 10B, respectively.

The Geneva wheel arrangement 40 comprises: two Geneva wheels $40_1$, and $40_2$ and two corresponding gears $40B_1$, $40B_2$ which are mounted on shafts $40A_1$ and $40A_2$ respectively. The two gears $40B_1$, $40B_2$ are arranged to be in constant mesh with a third idler-like gear $40B_3$. The perimeters of the two Geneva wheels are arranged in very close proximity to one another. The gears $40B_1$, $40B_2$ have a diameter which is smaller than that of the corresponding Geneva wheels.

In this embodiment, each of the Geneva wheels is formed with a single pin receiving recess 40C (viz., $40C_1$, $40C_2$). These recesses are dimensioned to pick-up and temporarily retain a tray pin 12G. The Geneva wheels 40 are arranged to rotate in the same rotational direction due to the provision of gear $40B_3$ and thus induce the recesses 40C to cyclically pass through the positions indicated in FIGS. 7A to 7E.

The Geneva wheel arrangement 42 is essentially the same as the one described immediately above and accordingly a redundant description of the same will be omitted for brevity.

Figure 5:
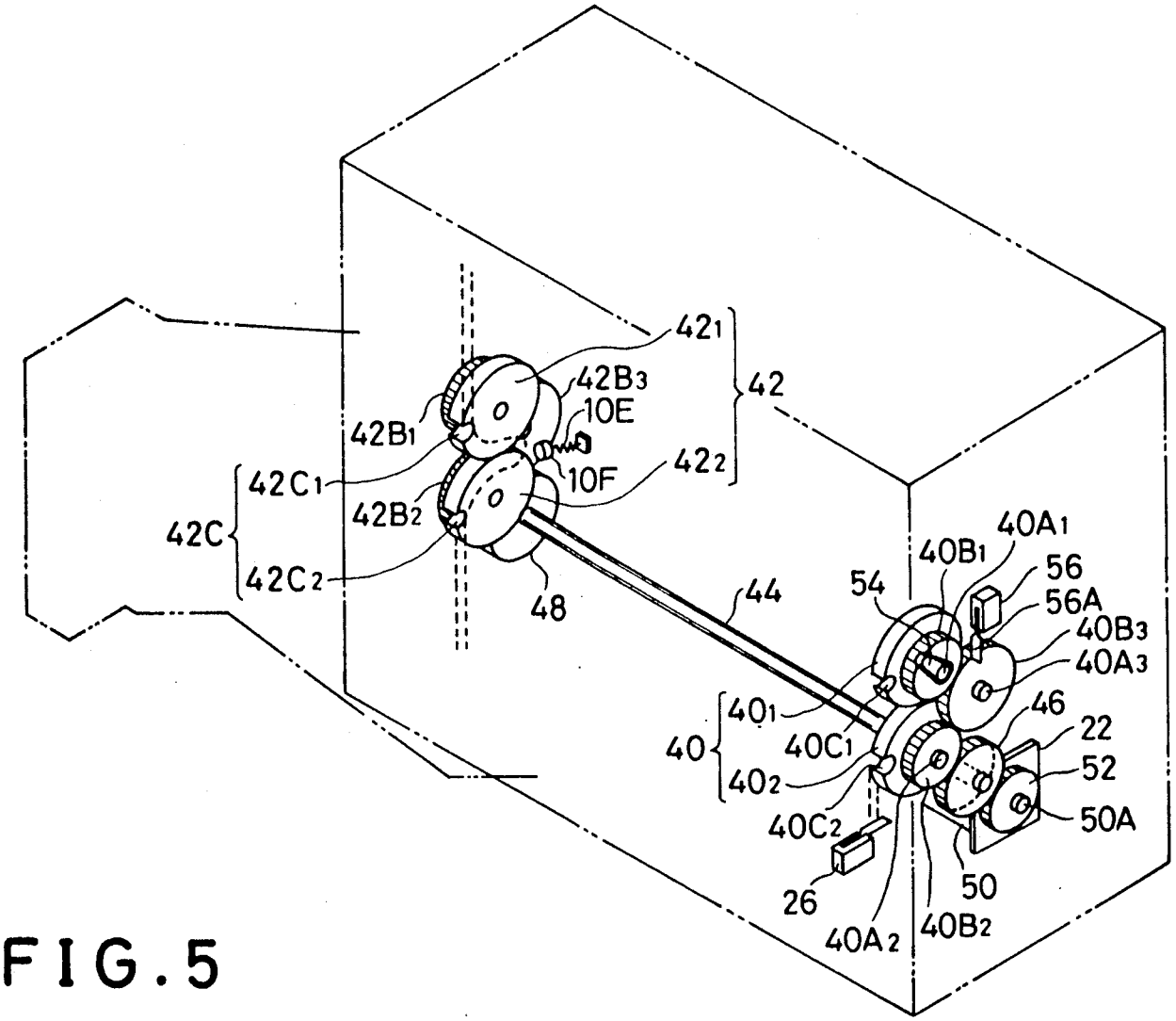
FIG. 5 is a perspective view showing details of the tray shift and displace mechanism which is used in the first embodiment of the present invention.
Figure 6:
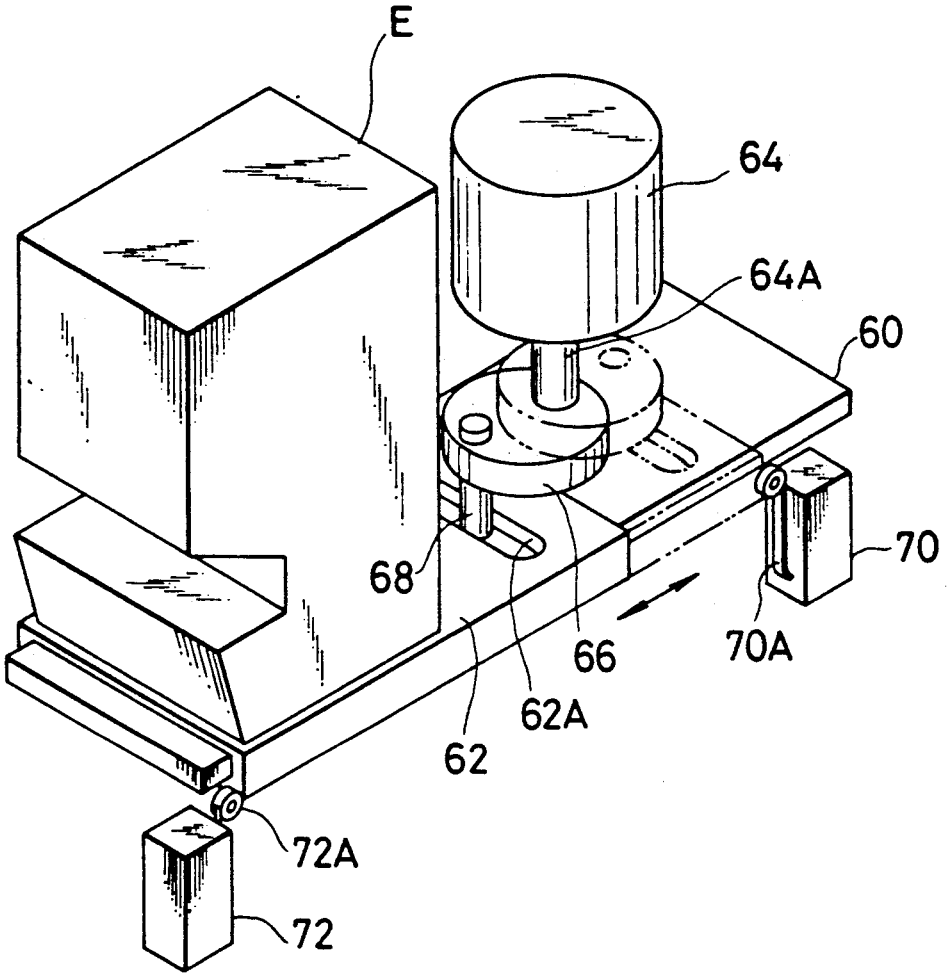
FIG. 6 is a perspective view showing the mechanism on which the stapler is mounted in accordance with the first embodiment.

As shown in FIG. 5, a shaft 44 extends between and is rotatably supported by the side frames 10A and 10B. Gears 46, 48 are mounted on the ends of this shaft and arranged to mesh with the gears $40B_2$ and $42B_2$. A motor 50 is mounted on the side frame 10A. A gear 52 which is mounted on the output shaft 50A of the motor is arranged to be in constant mesh with gear 46. This establishes a drive connection between the motor 50 and each of the Geneva wheel arrangements.

In the instant embodiment, the two Geneva wheel arrangements 40, 42 are arranged at the same height. However, the right hand tray pins 12G are arranged at the same height as the base portion of each of the trays while the left tray pins 12H are arranged at locations which are proximate the bottom of the left side walls 12C. As a result, the trays 12 are oriented at a skewed angle in a manner wherein the corners in which the cut-outs 12E are formed, are maintained at a position which is lower than the other corners.

When the motor 50 is energized in a first rotational direction, the tray pins 12G, 12H at the rear of a tray 12 are picked up by the Geneva wheel arrangements 40, 42 and moved upwardly. This initiates a fan-like spreading of the trays.

It should be noted that a cam 54 is connected to the shaft $40A_1$ on which Geneva wheel $40_1$ and gear $40B_1$ are mounted. This cam 54 is arranged to engage a lever 56A which extends from a switch 56 mounted on the side frame 10A, in a manner which triggers the switch 56 and marks a position in which the rotation of the Geneva wheel arrangements 40, 42 should be stopped and/or a predetermined operation carried out.

A lower limit switch 58 is mounted on the side frame 10A proximate the lower end of the guide slot 10C. This switch 58 is provided with a lever 58A. This latter mentioned element is arranged to be engaged by the guide pin 18B in a manner which indicates that the tray pins $12G_1$, $12H_1$ of the uppermost tray $12_1$ are received in the recesses $40C_1$, $42C_1$ of the upper Geneva wheels $40_1$ and $42_1$, respectively.

TRAY SHIFT AND DRAWING MECHANISM

For the sake of simplicity, a discussion of the arrangement mounted on the right side frame 10A will be given although it is to be understood that corresponding operations take place on both sides.

As shown in FIGS. 7A-7E, guide slot 10C is formed with mirror image curved guide arrangements which comprise curved portions $10C_1$ and $10C_2$ which match the curvature of locus of the recesses $40C_1$, $40C_2$ for about ¼ of the periphery of the Geneva wheels and then extend tangentially to an intersection portion $10C_3$.

As will be appreciated the combination of the curved portions of the guide slots 10C with the Geneva wheels is such that each Geneva wheel can laterally displace a pin through a distance corresponding to approximately ¾ of its diameter.

Spring 10E and stopper 10F are arranged at the intersection portion $10C_3$ ($10D_3$) to bias the tray pin which has been carried to the intersection portion by the rotation of the Geneva wheels, into engagement with the outer peripheries of the wheels.

STAPLER

A base plate 60 (see FIG. 6) is fixed to the side frame 10A. A slider 62 on which the stapler E is supported, is reciprocatively mounted on the base plate 60. A motor 64 mounted on side frame 10A. A crank wheel 66 is eccentrically mounted on an output shaft 64A of the motor. A pin 68 which extends from the periphery of the crank wheel 66 extends through a laterally extending slot 62A formed in the slider 62.

In the instant embodiment the stapler E may take the form of an electrically operated O.M.E. Standard Model #69031 or O.M.E. Wide Gap Model #69035 manufactured by the Swingline Company of the United States.

A retracted position sensor switch 70 is mounted adjacent the base plate 60. This switch 70 is provided with a lever 70A which is arranged to be engaged by the slider 62 when it assumes a fully retracted position such as indicated in phantom.

A forwardly extended position sensor switch 72 is mounted adjacent the base plate 60. This switch 70 is provided with a lever 72A which is arranged to be engaged by the slider 62 when it assumes a fully extended position such as indicated in solid line.

OPERATION

A control unit (not shown) which is disposed in the main casing A and which includes a microprocessor or microcomputer, receives data from the associated host copy or printing machine indicative the number of stacks the sheets must be divided into, the number of sheets for each stack, etc. In response to this information the motor 50 is energized to rotate in a first rotational direction. This induces the Geneva wheel arrangements 40, 42 to pick up the tray pins 12G, 12H of the trays and induce the trays 12 to undergo a downward shift. The uppermost tray $12_1$ reaches a position wherein it can receive sheets from the sheet transfer guide 20 (viz., assumes what shall be referred to as an initial tray setting).

In this instant embodiment, when this initial tray setting is achieved, the tray pins $12G_1$ and $12H_1$ of the upper tray $12_1$ are located in the intersection portions $10C_3$ and $10D_3$, respectively, and biased into contact with the peripheries of the Geneva wheels $40_1$, $40_2$ and $42_1$, $42_2$ via due to engagement with the spring biased stoppers 10F, 10F, respectively. Under these conditions the tray $12_1$ is drawn laterally rearward so as to project toward the stapler and the carrier side plate 18 is lowered to the point whereat the lower limit switch 58 is triggered by the guide pin 18B engaging the lever 58A. The rotation of motor 50 is stopped in response to the triggering of the lower limit switch 58.

A counter included in the control unit also responds to the triggering of the lower limit switch 58 and clears a counter included therein and resets the same to zero.

When a sheet of copied material and the like are supplied into the transfer guide 20, motor 32 is energized in response to the operation of the sheet sensor 38. This drives the transfer and pinch rollers 22 and 24 and induces the sheet to be ejected onto the uppermost tray $12_1$. The ejected sheet moves under its own weight until it rests against the side and rear walls 12B, 12D of the tray in question.

The control unit responds to the output of the sheet sensor 38 indicating that the sheet has passed through the transfer guide 20 and energizes the motor 50 in a manner wherein it rotates in a second rotational direction. This induces the Geneva wheel arrangements 40, 42 to shift the top tray $12_1$ upwardly.

TRAY SHIFTING

Figures 7A, 7B, 7C, 7D, 7E:
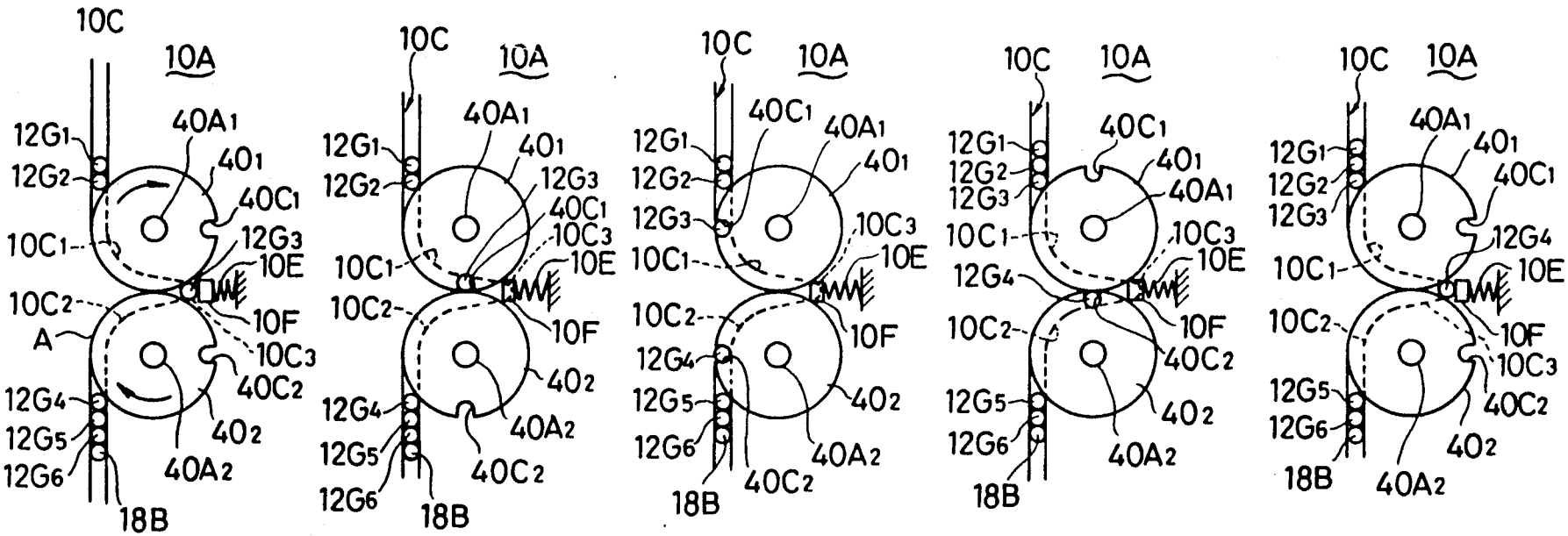
FIGS. 7A-7E show the manner in which the tray shift mechanism moves the trays during operation of the sorter.
Figure 8:
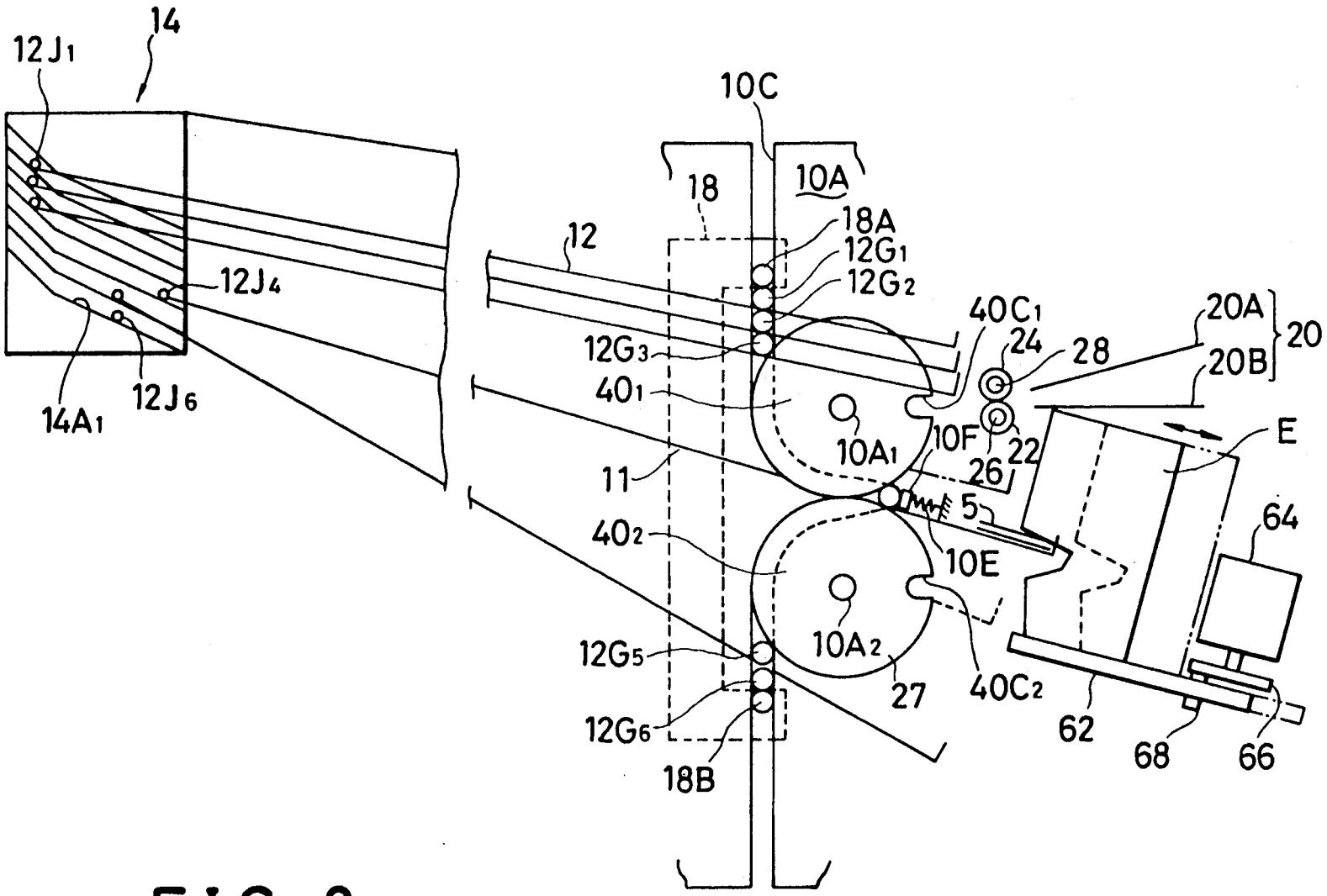
FIG. 8 is a schematic side elevational view showing the sorter according to the first embodiment in operation.
Figures 9A, 9B, 9C, 9D, 9E:
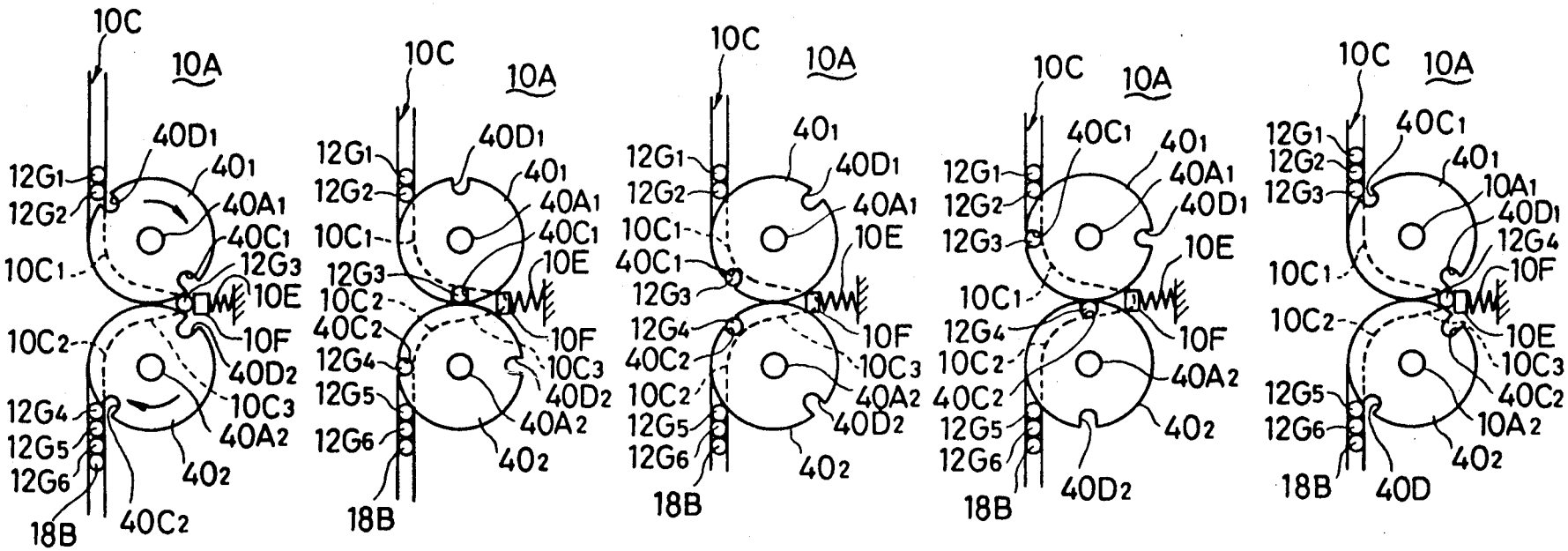
FIGS. 9A-9E show the manner in which a second embodiment of the present invention effects tray shifting during the operation of the sorter.

FIGS. 7 and 8 show details of the above mentioned tray shifting operation. FIG. 7A shows the situation wherein the tray $12_3$ is located in a position to have sheets ejected thereonto. At this time the tray pins $12G_2(12H_2)$ (only $12G_2$ is shown) of the second tray $12_2$ are resting on the outer peripheral surfaces of the top Geneva wheels $40_1(42_1)$ while the tray pins of the third tray $12_3$ are in abutment with the stoppers 10F, 10F. As will be appreciated from FIG. 8 a relatively large gap is opened up between the inboard (rear) ends of the second and third trays $12_2$, $12_3$. It will be noted that as the tray pins of the 4th and 5th trays are resting on top of the guide pins 18B(16B) of the carrier side plates 18 and 16, as the latter are moved upwardly each time a tray pin is moved to the top of the Geneva wheel arrangements, the tray pins $12G_4(12H_4)$ of the fourth tray are displaced upwardly into contact with the peripheries of the lower Geneva wheels $40_2(42_2)$.

As will be noted, under these conditions the recesses $40C_1$ and $40C_2$ ($42C_1$, $42C_2$) formed in the Geneva wheels are located at in the same rotational positions (e.g. at 3:00). As the wheels rotate from the positions shown in FIG. 7A to that shown in FIG. 7B the recesses $40C_1$, $40C_2$ both move to their 6:00 positions. As the recess $40C_1$ ($42C_1$) passes a position wherein it is diametrically opposed to the pin which is in abutment with the stopper 10F, the pin is pushed into the recess under the bias of the spring 10E and carried therein to the 6:00 position.

As the Geneva wheels continue to rotate from the positions shown in FIG. 7B toward those shown in FIG. 7C, the recess $40C_2$ formed in the lower Geneva wheel $40_2$ picks up the next tray pin (in this case pin $12G_4$ ($12H_4$) and moves it along the guide slot $10C_2$ ($10D_2$) until it reaches the beginning of the curved portion $10C_2$. At the same time pin $12G_3$($12H_3$) is moved upwardly to the end of the curved portion $10C_1$ ($10D_1$) of the guide slot 10C(10D). Following this, the next stage of the rotation is such that pin $12G_3$($12H_3$) slides out of the recess $40C_1$ and begins riding on the external periphery of the upper Geneva wheel $40_1$ as shown in FIG. 7D. At this time pin $12G_4$($12H_4$) reaches a 12:00 position. As the Geneva wheels $40_1$, $40_2$ rotate so that the recesses $40C_1$ and $40C_2$ to again assume their 3:00 positions, pin $12G_4$($12H_4$) is moved into the intersection portion $10C_3$ of the guide track and into abutment with the spring loaded stopper 10F which maintains it in sliding contact with the outer peripheries of the two wheels ready to be picked up by the next passage of the recess $40C_1$.

Upon completion of one rotation of the Geneva wheels from the positions shown in FIG. 7A (to those shown in FIG. 7E) one full upshift operation of a tray has been completed and drawing operation of the next tray has been completed. (the same condition is illustrated in FIG. 8.)

In this embodiment, as the tray pin 12G is guided during tray drawing operation by intersection portion $10C_3$ extended in a direction along a common tangent of Geneva wheels $40_1$ and $40_2$, the rear end of the tray 12 is displaced laterally with a small amount of vertical movement, resulting in enabling usage of various types of staplers.

As will be appreciated, as each tray upshift is completed, the next tray undergoes a lateral displacement wherein it is projected rearwardly to a degree wherein sheet ejection and collection is facilitated. Further, the angle between the projected tray and that which has just finished passing through the Geneva wheel mechanism, is increased enabling the collection of relatively large number of sheets on each tray.

As each tray is shifted upwardly, the tray pins 12G, 12H are transferred along the guide slots 10C, 10D and induce the guide pins of the carrier side plates 16, 18 to also move upwardly. This induces the situation wherein the tray pins 12J which are received in the grooves 14A of the guide member 14, are also vertically displaced but in a manner wherein the necessary inclination of the trays 12 on which sheets of printed matter have been ejected, is maintained.

It will be noted that the front side of the groove 14A is steeper than the rear side thereof so that a large gap formed between trays is obtained to facilitate easy sheet ejection.

After the trays have shifted up and down enough times to permit the collation of the sheets to be completed, the trays 12 are all downshifted to the above mentioned initial tray setting. Upon this condition being achieved the lower limit switch 58 is triggered and the counter in the control unit is reset to zero.

STAPLING

It will be remembered that each time the Geneva wheel arrangements complete a rotation, the cam 54 triggers switch 56 at a timing when the trays have undergone a maximum amount of lateral displacement toward the stapler E, and are located in the condition illustrated in FIG. 8. Each time a tray assumes this position the shifting is stopped and the control unit energizes motor 64 in a manner which rotates the crank wheel 66 through 180° and causes slider 62 to slide from the position in which switch 70 is triggered to one shown in bold line in FIGS. 6 and 8. In this position, lever 72A of the stapler position detection switch 72 is engaged by the leading end of the slider 62 and the rotation of the motor 64 is stopped.

Under these conditions the stapler E is positioned over the cut-out 12E of the extended tray and stack of sheets which have been collected thereon. The stapler E is actuated to fasten the sheets in response to the output of the position detection switch 72.

After the stapling operation, the motor 64 is reenergized and the stapler E is moved back toward the position illustrated in broken line in FIG. 8. Upon reaching this position, the stapler initial position sensing switch 70 is triggered, the motor 64 is stopped and the next tray shifting operation is resumed to bring the next tray to a position suitable for stapling of the sheet thereon.

SECOND EMBODIMENT

FIGS. 9A-9E show a second embodiment of the present invention. This arrangement is directed to speeding the rate at which the trays can be shifted.

In this embodiment each of the Geneva wheels are provided with two diametrically opposed recesses. This enables the number of trays which are shifted to be basically doubled per rotational operation of the Geneva wheel arrangements.

As shown in FIGS. 9A-9E each of the Geneva wheels $40_1$, $40_2$ each has 2 recesses ($40C_1$, $40C_2$, $40D_1$, $40D_2$). Accordingly, each rotation of a Geneva wheel twice the trays are shifted as compared with first embodiment. In other words, with the second embodiment, one tray is shifted every 180° of rotation.

With the above described embodiment the arrangement which shifts and positions the trays enables the laterally displaced tray to be maintained in a static condition so that it is not necessary to stop and start motor 50 and enables the load on the same to be reduced.

Of course if it is preferred, the motor 50 and the Geneva wheels can be stopped periodically. Even though this produces some variation in the positions in which the Geneva wheels actually stop, the accuracy of the tray positioning is not effected to any noticeably degree because the laterally displaced tray is maintained in a static condition as discussed above.

THIRD EMBODIMENT

Figure 10:
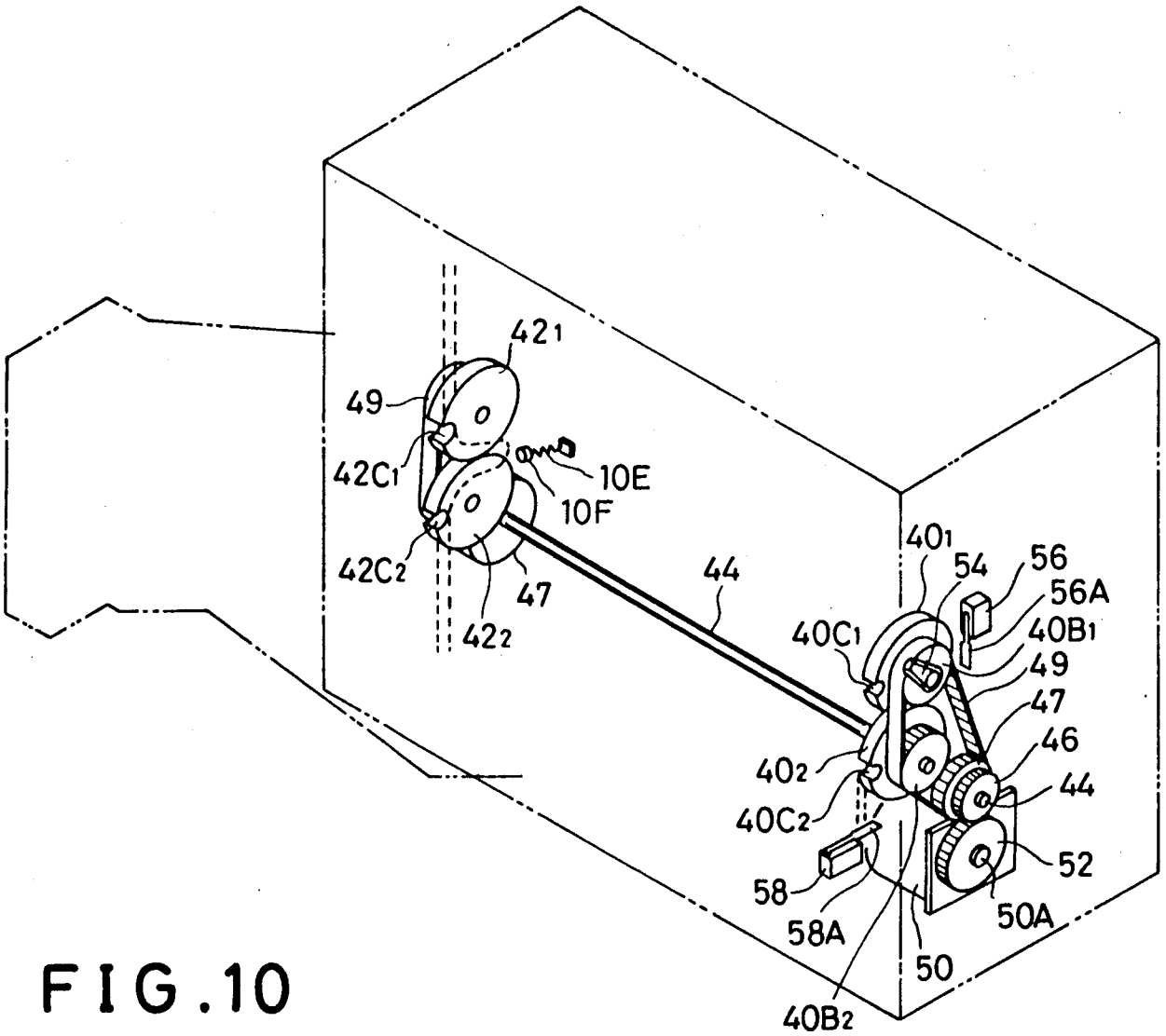
FIG. 10 is a perspective view showing constructional details of the tray shifting mechanism according to a further embodiment of the present invention.

FIG. 10 shows a third embodiment of the present invention. In this arrangement a belt is used to drive the Geneva wheels. More specifically, a timing pulley 47 is mounted on the shaft 44 at a location proximate the gear 46. A timing belt 49 is arranged to establish a drive connection between the timing pulley 47 and the gears $40B_1$, $10B_2$ which are associated with the Geneva wheels $40_1$ and $40_2$, respectively. Although not shown in FIG. 10, it will be understood that a similar drive belt connection is established between the Geneva wheels $42_1$ and $42_2$.

It will be noted that while the embodiment of the present invention have been disclosed in connection with a stapler having a moving a mechanism which moves forwardly and rearwardly in response to lateral displacement of a tray, it is not necessary to provide the stapler with such a moving mechanism except that staplers the mouth of which are small are used.

It will also be noted that while the embodiments of the present invention have been disclosed in connection with a stapler, it is within the scope of the present invention to use alternative bookbinding arrangements such as those which applies an adhesive or the like to the edges of the sheets in a manner to bind the same together.

The invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A sorter comprising:

a plurality of vertically movable trays;

means for shifting said plurality of trays and for maintaining a tray in a predetermined position in which sheets can be received thereon, said shifting and maintaining means including at least one set of Geneva wheel arrangements having two Geneva wheels vertically arranged and rotatably supported in a predetermined relationship with one another, each of the Geneva wheels having at least one recess formed therein; and a frame having a pair of guide slots, including first and second guide slots, each having vertical portions, mirror image first and second curved portions respectively corresponding to the locus of said recess in each of said Geneva wheels, and tangential extrapolations which merge together at an intersection portion;

means for ejecting a sheet onto a tray which is maintained in said predetermined position;

means associated with said set of Geneva wheel arrangements and said first and second guide slots for inducing one of said trays to undergo lateral displacement; and fastening means for fastening a stack of sheets accumulated on said laterally displaced tray together.

2. A sorter as claimed in claim 1 wherein said fastening means comprises a stapler.

3. A sorter as claimed in claim 2 wherein each of said plurality of trays is formed with:

a cut-out formed in one corner;

an upwardly extending rear wall which extends toward said cut-out; and a first upwardly extending side wall which extends toward said cut-out; and wherein said sorter further includes means for orienting each of said trays so that the corner in which said cut-out is formed is maintained at a level which is lower than the other corners.

4. A sorter as claimed in claim 3 wherein each of said trays further comprises a second side wall which extends downwardly from a second side edge thereof, said second side wall having a height which is greater than that of said first side wall;

wherein said first and second side walls have leading and trailing ends respectively, and wherein said second side walls has horizontally extending tray pins located proximate the leading and trailing ends respectively, and wherein said first side wall has a tray pin located proximate the trailing end.

5. A sorter as claimed in claim 4 wherein said first and second guide slots slidably receive the tray pins which extend from the locations proximate the trailing edges of said first and second walls, respectively;

first and second sets of Geneva wheels associated with each of said first and second guide slots, respectively, each of said first and second sets of Geneva wheels is arranged to operatively engage tray pins which are slidably received in said first and second guide slots and move the tray pins along said first and second guide slots respectively; and drive means for selectively driving the first and second sets of Geneva wheels in the same rotational direction.

6. A sorter as claimed in claim 5 wherein the Geneva wheels which are associated with each of said guide slots are arranged at the same height.

7. A sorter as claimed in claim 6 wherein sheet ejecting means comprises a transfer roller and a pinch roller, said transfer roller and pinch roller being rotatably supported on a transfer roller shaft and a pinch roller shaft respectively, said transfer roller shaft and said pinch roller shaft being arranged to extend laterally across the frame at a predetermined angle with respect to the frame.

8. A sorter as claimed in claim 6 wherein each said first and second guide slots has mirror image first and second curved portions which each respectively corresponds to about ¼ of the locus of the recess formed in the Geneva wheel.

9. A sorter as claimed in claim 8, further comprising biasing means for urging a tray pin which is located an intersection portion against the periphery of a Geneva wheel.

10. A sorter as claimed in claim 1, wherein each Geneva wheel comprises two recesses which are formed at essentially diametrically opposite locations.

11. A sorter as claimed in claim 9, wherein each Geneva wheel comprises two recesses which are formed at essentially diametrically opposite locations.

12. A sorter as claimed in claim 7, wherein said predetermined angle with respect to the frame is an intermediate angle between an angle at which sheets are received from a copy or printing machine and an angle of said trays.

13. A sorter comprising:

a plurality of vertically movable trays which have tray pins slidably received in guide slot means;

shifting means for vertically displacing said plurality of trays and for maintaining a tray in a predetermined position in which sheets can be received thereon, said shifting means including:

(a) at least one set of vertically arranged Geneva wheels which are rotatably supported in a predetermined relationship with one another and which are arranged to cooperate with one another in a predetermined manner, each of the Geneva wheels having at least one recess formed therein, and (b) biasing means for biasing a tray pin which is located at a predetermined portion of the guide slot means against the periphery of at least one of the Geneva wheels;

means for ejecting a sheet onto said a tray which is maintained in said predetermined position;

fastening means for fastening a stack of sheets together; and means associated with said plurality of Geneva wheels for inducing a tray to undergo lateral displacement in the direction of said fastening means.

14. A sorter comprising:

a frame;

a guide slot formed in the frame, said guide slot having a shaped central portion comprising mirror image curved portions and mirror image extrapolations which merge at an intersection portion;

a plurality of vertically movable trays, each of the trays having a tray pin slidably received in said guide slot;

first and second Geneva wheels, said Geneva wheels being mounted so that the peripheral edges thereof are located in close proximity to one another and operatively connected with selectively energizable drive means in a manner to be driven in the same rotational direction;

means defining first and second recesses in a peripheral edge said first and second Geneva wheels respectively, said first and second Geneva wheels being located so that portions of the loci of said first and second recess have a predetermined overlapping relationship with the mirror image curved portions of said first guide slot; and a resilient stopper which is disposed at the intersection portion of the guide slot and arranged to bias a tray pin which is moved along the guide slot to the intersection portion, against the peripheral edges of the first and second Geneva wheels.

* * * * *